US007140175B2

(12) United States Patent
Verniau

(10) Patent No.: US 7,140,175 B2
(45) Date of Patent: Nov. 28, 2006

(54) THROTTLE CONTROL DEVICE IN PARTICULAR FOR TURBINE AERO ENGINE TEST BENCH

(75) Inventor: Jean-Luc Verniau, Viry Chatillon (FR)

(73) Assignee: SNECMA Moteurs, Paris (FR)

( * ) Notice: Subject to any disclaimer, the term of this patent is extended or adjusted under 35 U.S.C. 154(b) by 126 days.

(21) Appl. No.: 11/013,436

(22) Filed: Dec. 17, 2004

(65) Prior Publication Data

US 2005/0150206 A1 Jul. 14, 2005

(30) Foreign Application Priority Data

Jan. 13, 2004 (FR) ..... 04 00270

(51) Int. Cl.
*F02C 9/28* (2006.01)

(52) U.S. Cl. ..... 60/243; 60/39.281

(58) Field of Classification Search ..... 60/39.27, 60/39.281, 233, 240, 243; 244/234
See application file for complete search history.

(56) References Cited

U.S. PATENT DOCUMENTS 2,657,574 A 11/1953 Whitehead
2,664,762 A * 1/1954 Morris ..... 60/39.281
2,866,385 A 12/1958 Miller
4,466,278 A 8/1984 Remus
5,029,778 A * 7/1991 DeLuca ..... 244/234
5,188,316 A * 2/1993 Dressler et al. ..... 244/234

FOREIGN PATENT DOCUMENTS

FR 2 576 973 8/1986

* cited by examiner

*Primary Examiner*—L. J. Casaregola
(74) *Attorney, Agent, or Firm*—Oblon, Spivak, McClelland, Maier & Neustadt, P.C.

(57) ABSTRACT

The invention concerns a throttle control device for an aircraft turbine engine. It comprises a control assembly acting on the native command of the turbine engine (MT1–MT3) as a function of a manual input defined by a pilot control element (1). The pilot control element gives a lever angular position signal (CL, 10JS). The control assembly comprises:

Figure 1:
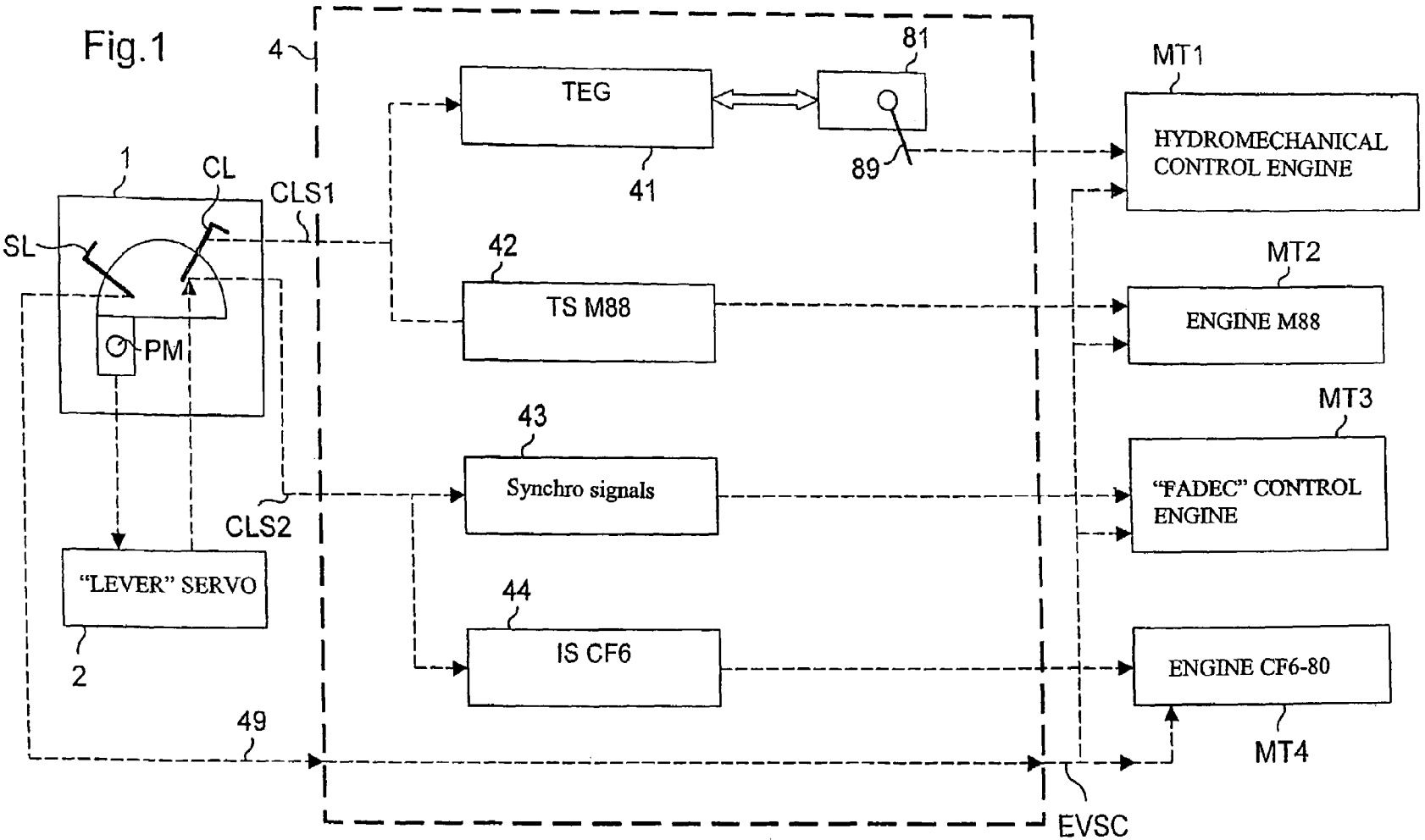

an automatic device (4) for converting the lever angular position signal into a transformed angular position signal following a selected command law, and an interface (70) for converting the transformed angular position signal into two sinusoidal signals of the resolver type, thus allowing control by the same device of different turbine machines such as turbine machines which have native command by sinusoidal type signals.

17 Claims, 15 Drawing Sheets

Fig.7
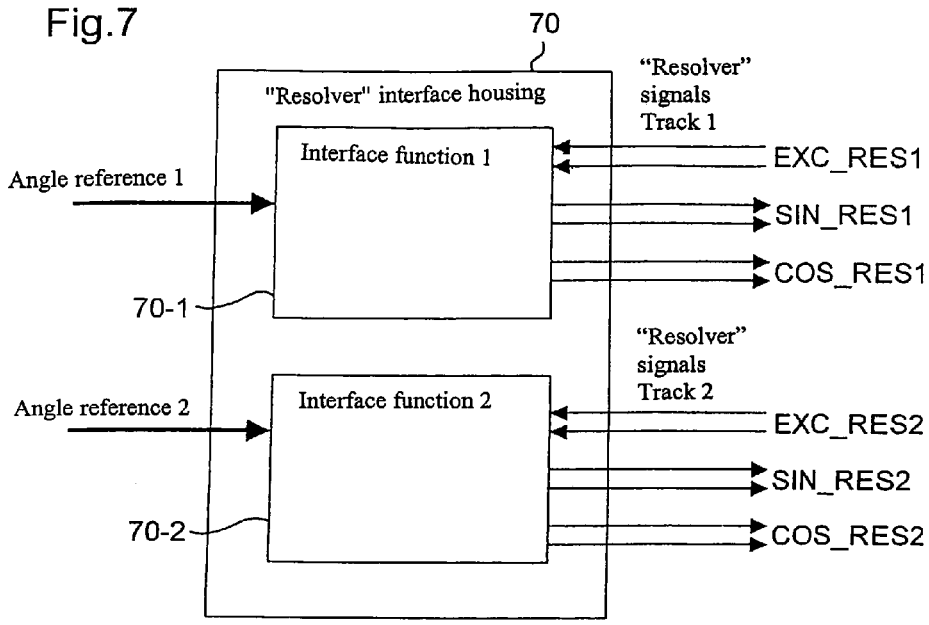
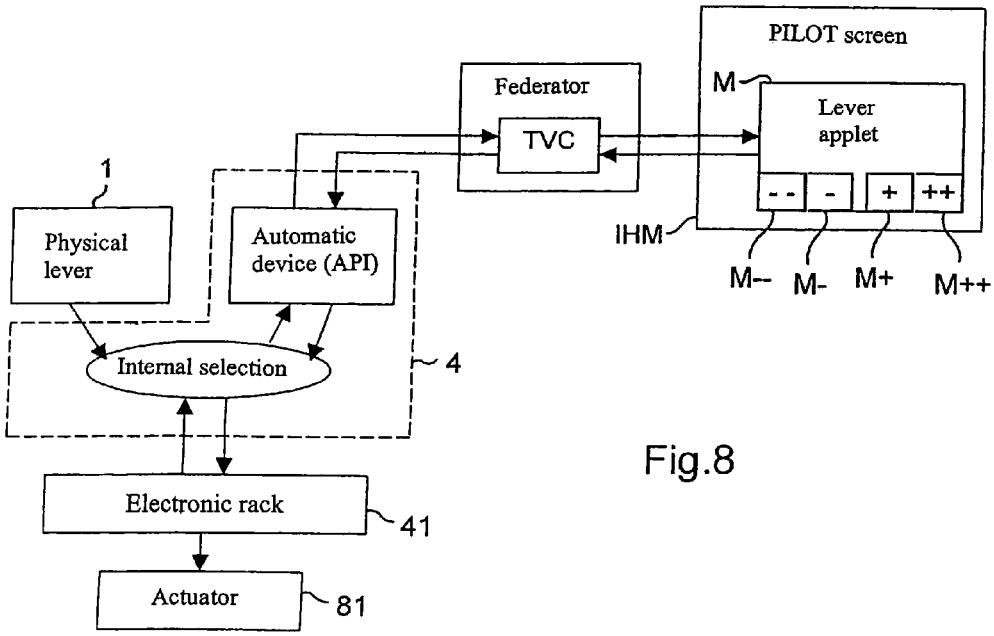
Fig.8

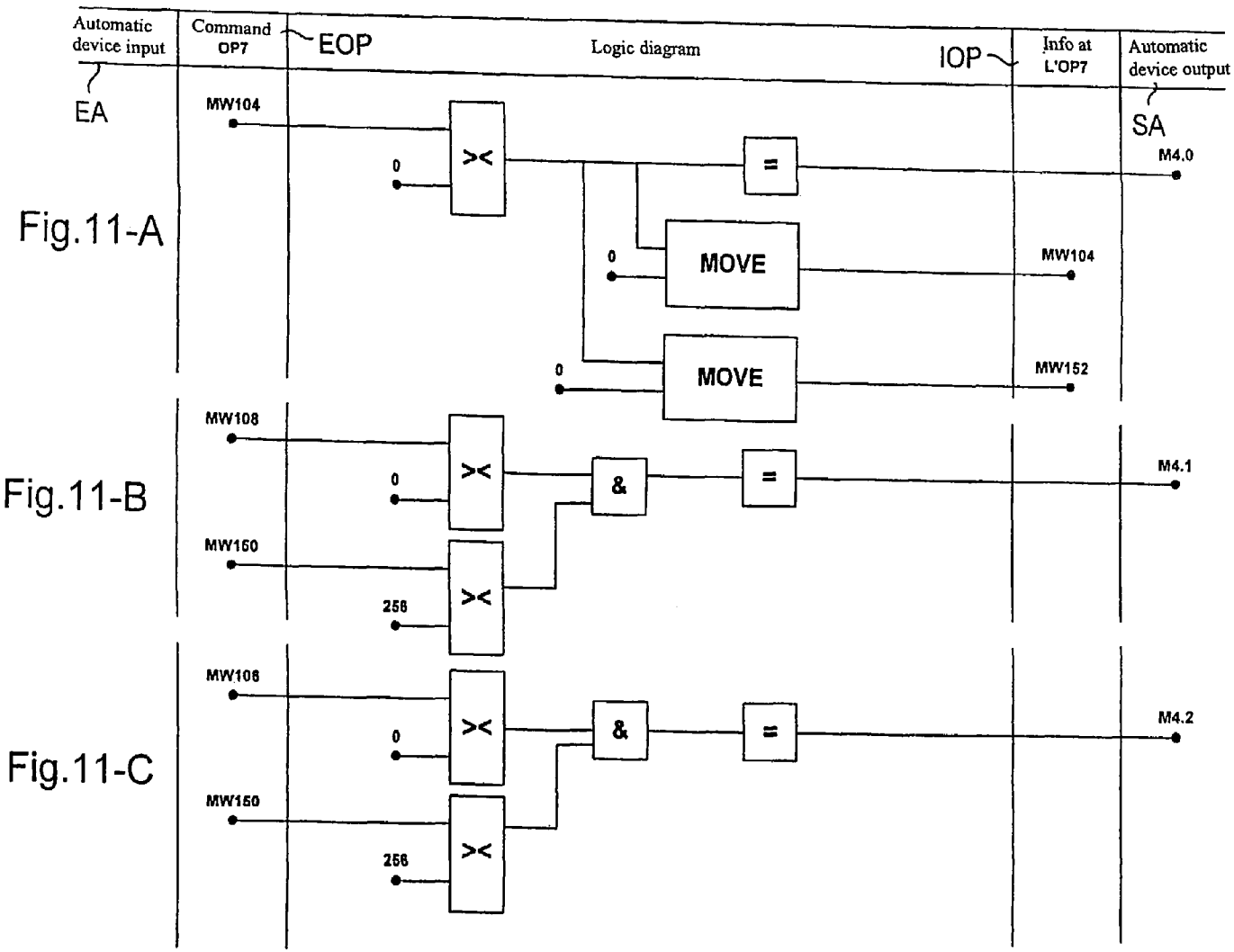
Fig.11-A
Fig.11-B
Fig.11-C

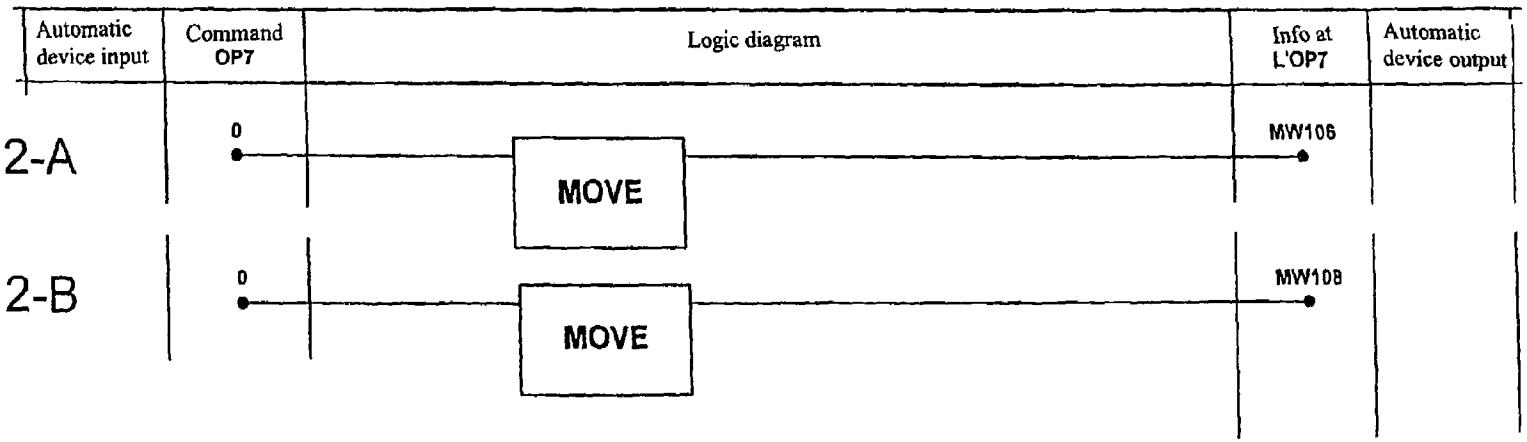
Fig.12-A
Fig.12-B
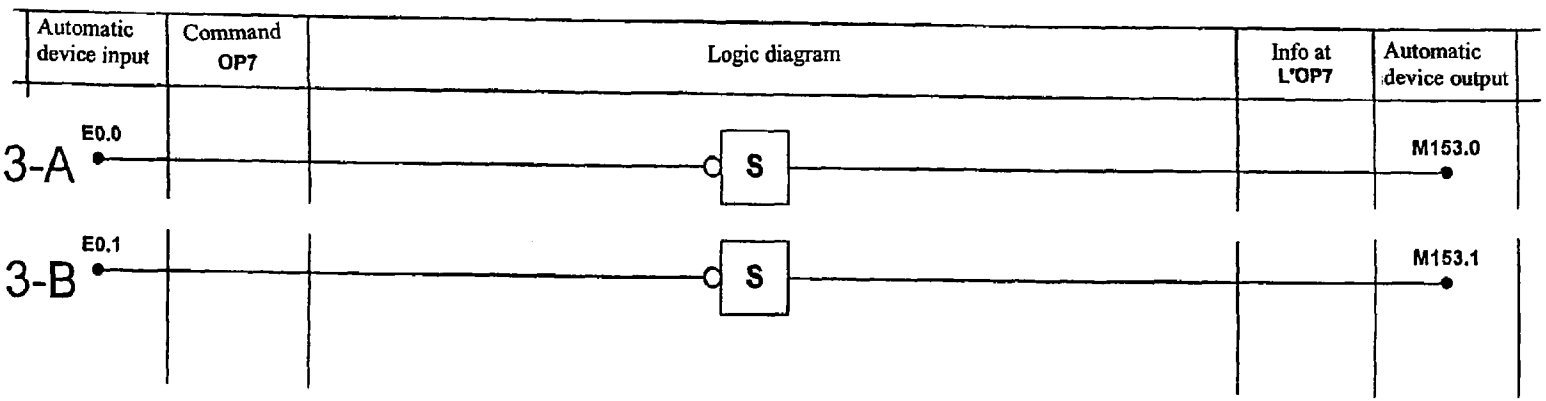
Fig.13-A
Fig.13-B

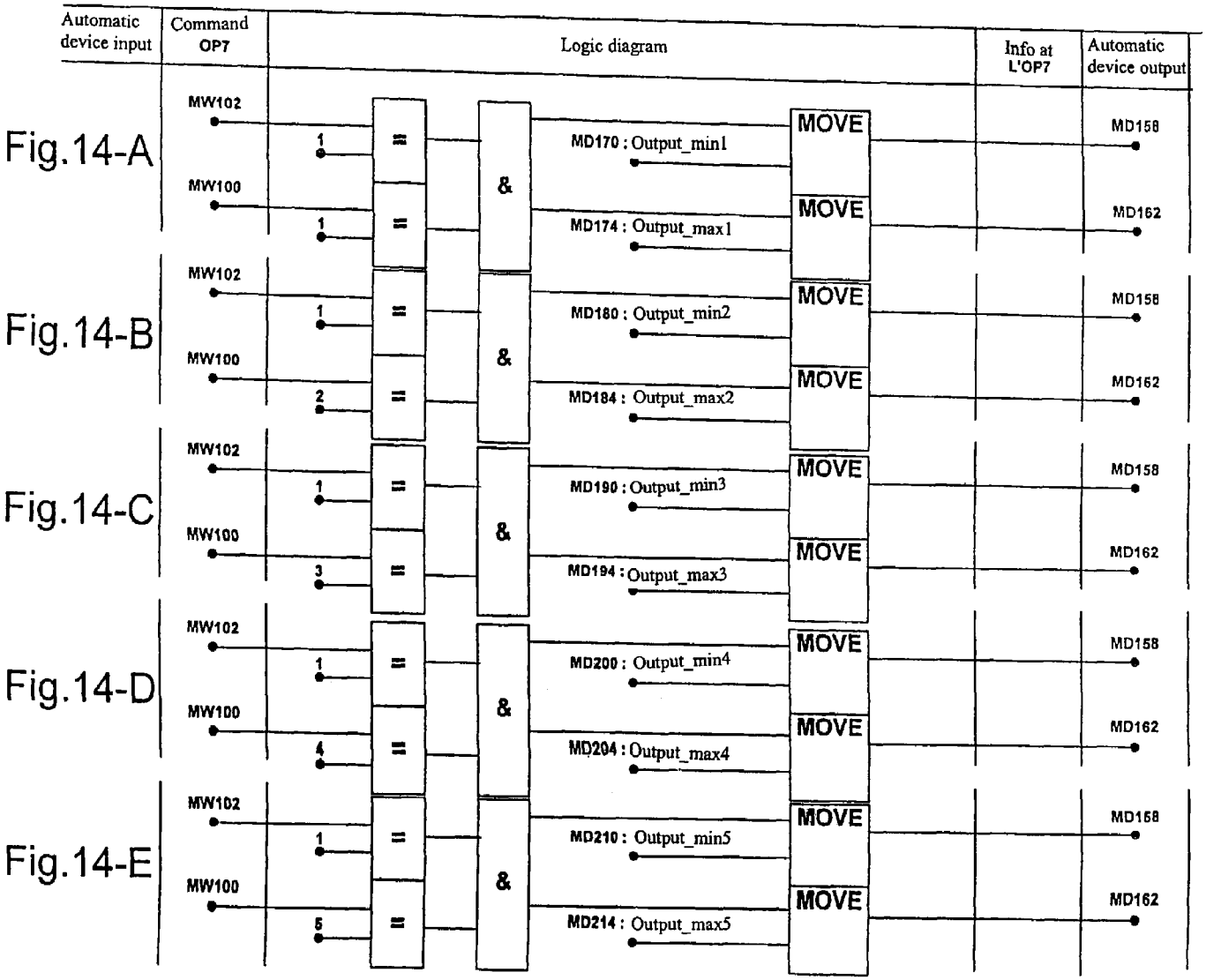
Fig.14-A
Fig.14-B
Fig.14-C
Fig.14-D
Fig.14-E

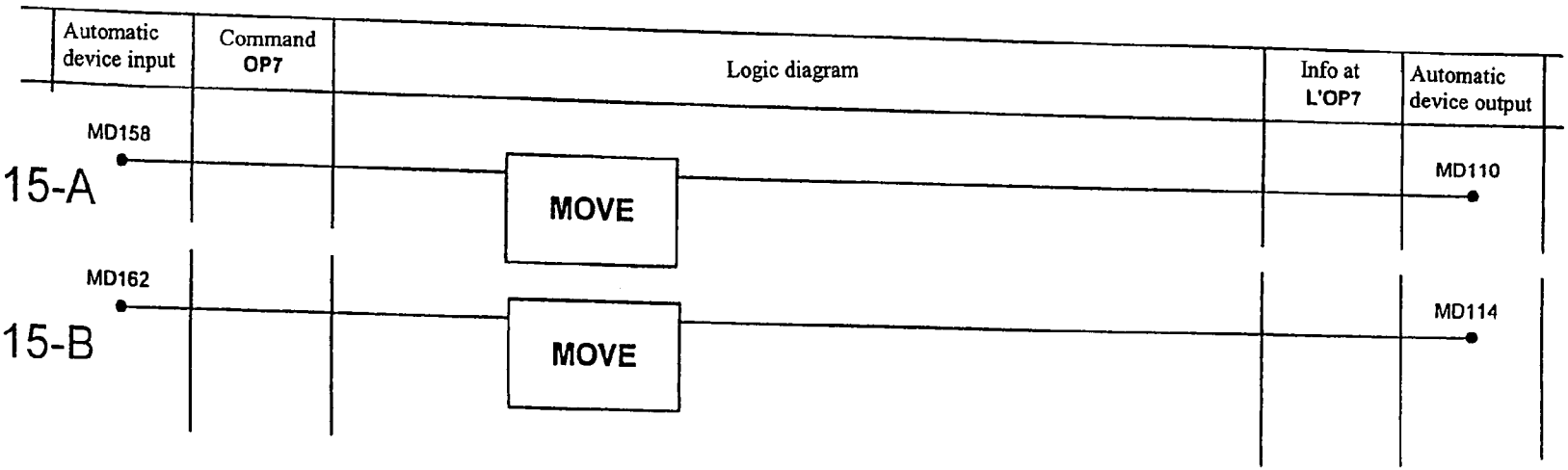
Fig.15-A
Fig.15-B

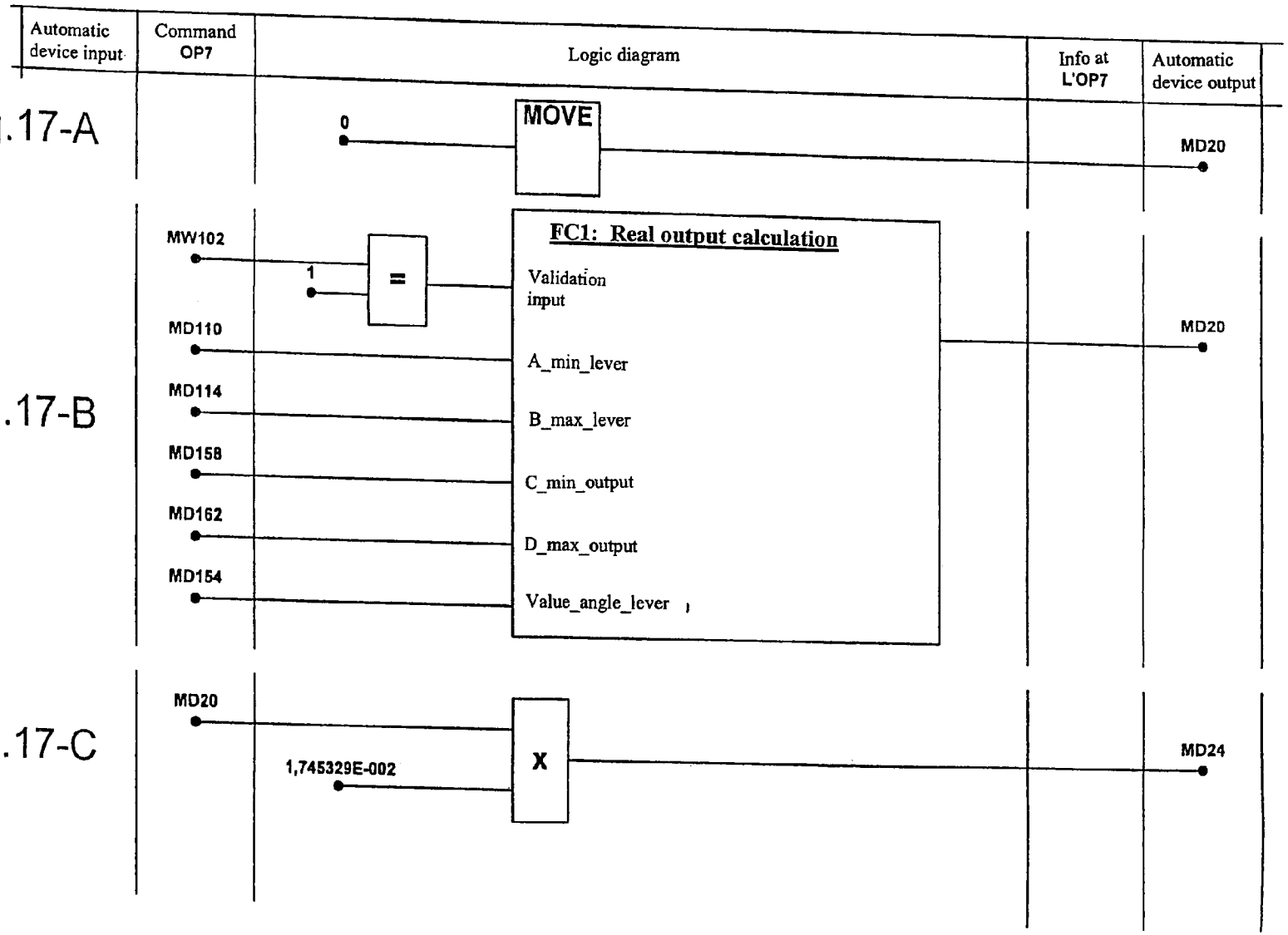
Fig.17-A
Fig.17-B
Fig.17-C

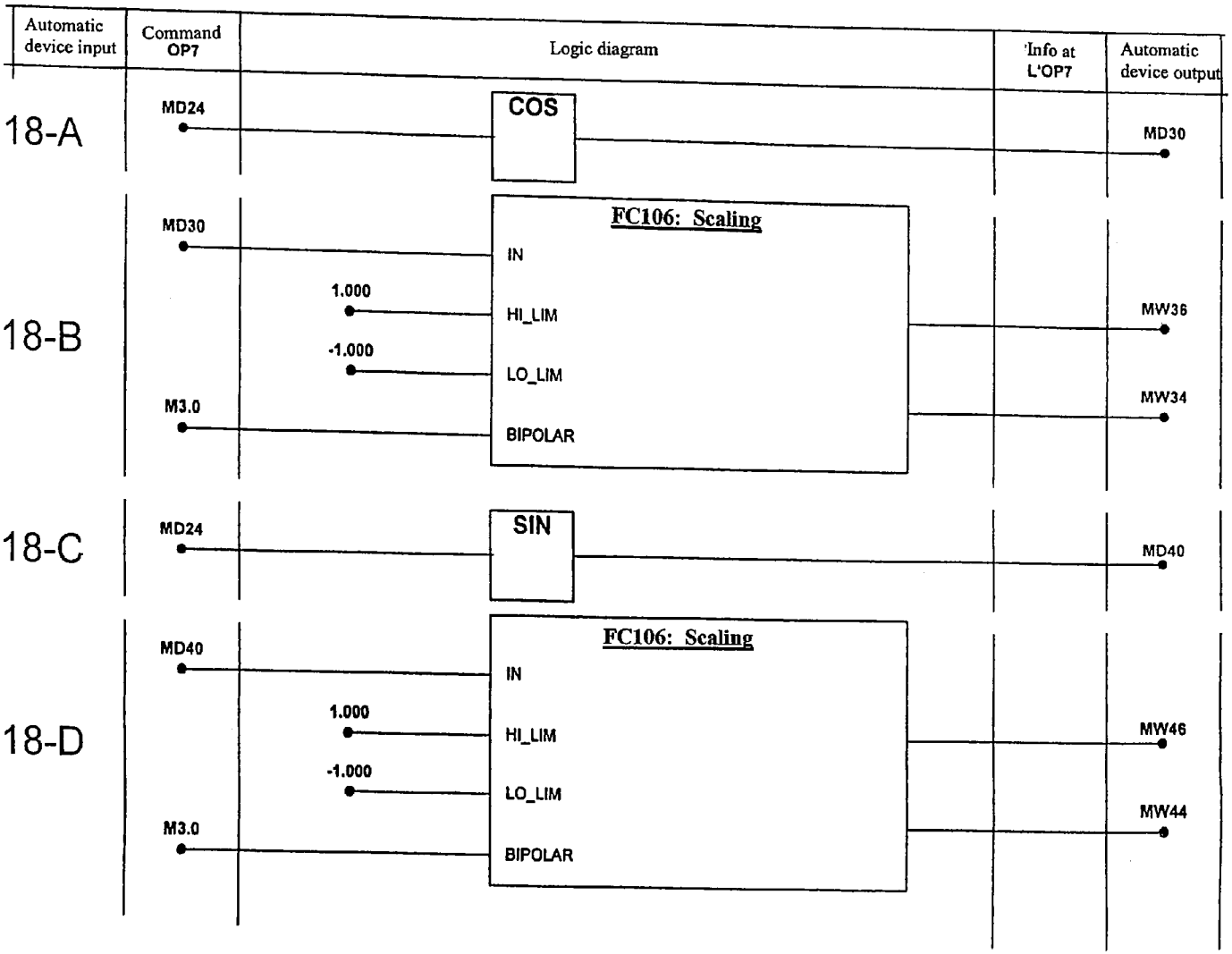
Fig.18-A
Fig.18-B
Fig.18-C
Fig.18-D

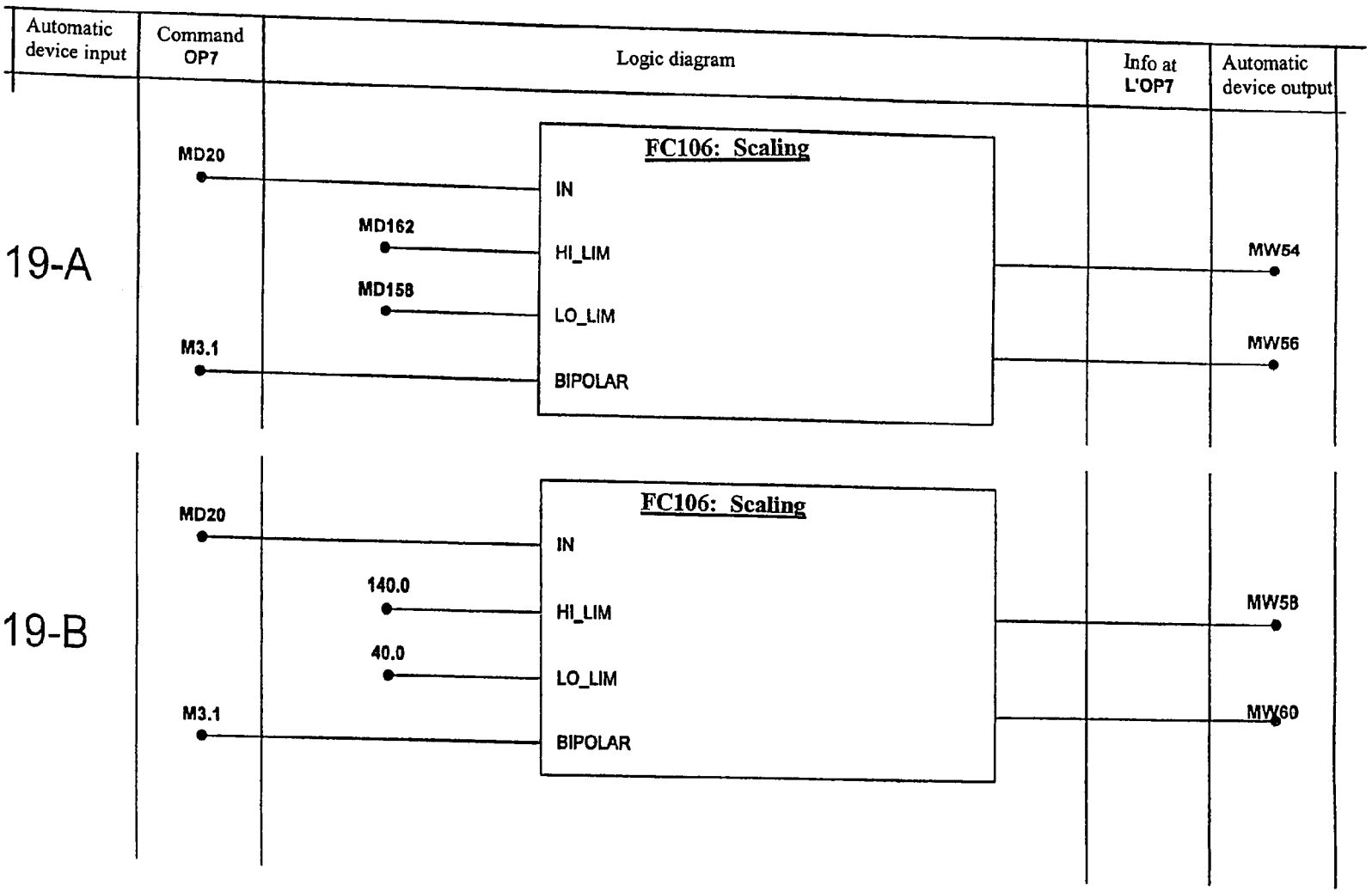
Fig.19-A
Fig.19-B

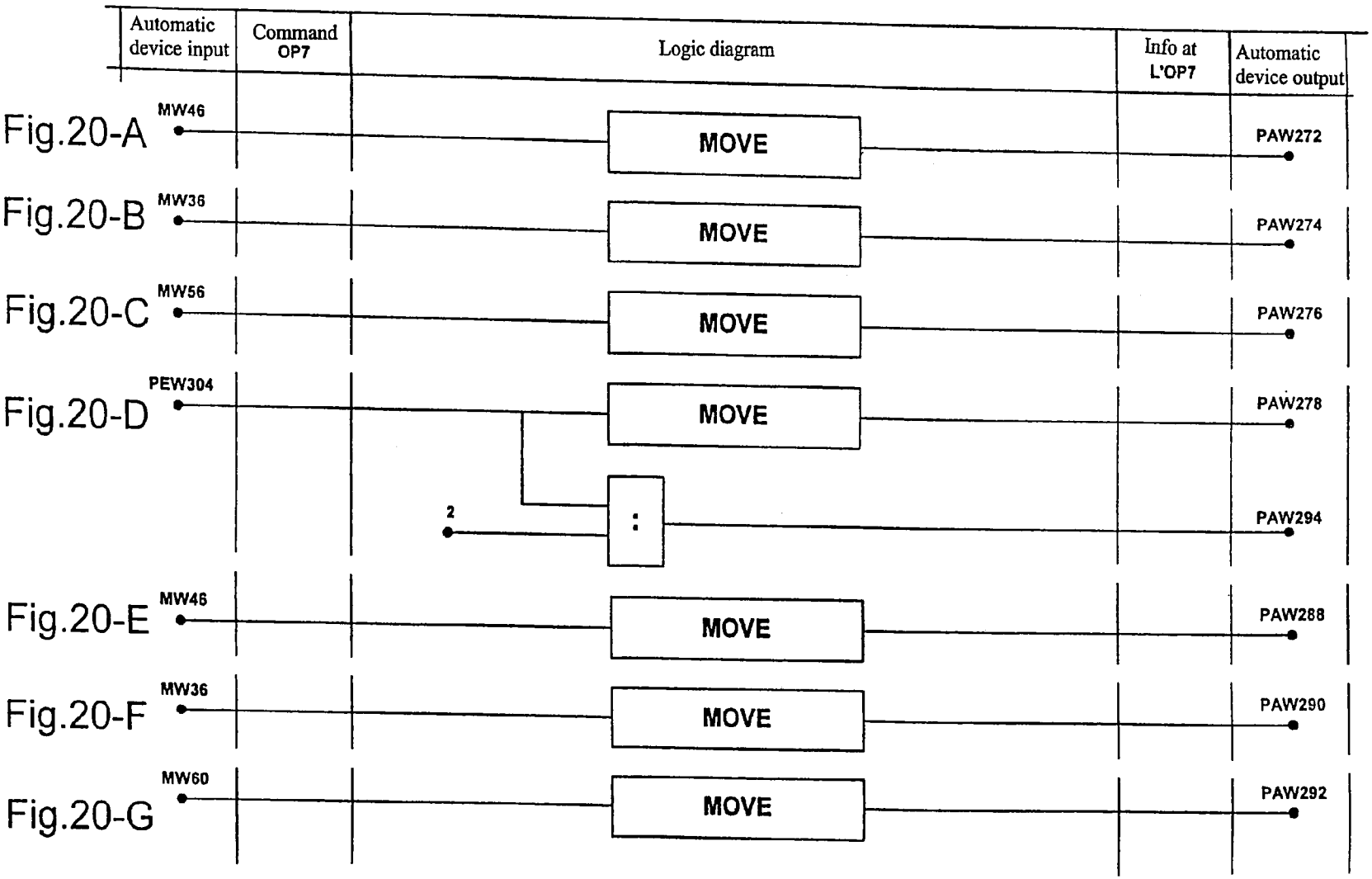
Automatic device input
Command OP7
Logic diagram
Info at L'OP7
Automatic device output
MW46
MOVE
PAW272
Fig.20-A
MW36
MOVE
PAW274
Fig.20-B
MW56
MOVE
PAW276
Fig.20-C
PEW304
MOVE
PAW278
2
PAW294
Fig.20-D
MW46
MOVE
PAW288
Fig.20-E
MW36
MOVE
PAW290
Fig.20-F
MW60
MOVE
PAW292
Fig.20-G

THROTTLE CONTROL DEVICE IN PARTICULAR FOR TURBINE AERO ENGINE TEST BENCH

The invention concerns turbine aero engines in general. This applies in particular to aircraft reactors.

The control modes of reactors, referred to here as engines, are relatively diverse. This is not a problem on an engine in normal service. However in certain situations such as during engine bench testing, this diversity leads to a wide diversity of equipment or even multiplication of the benches themselves which are then each dedicated to a particular type of engine, and hence finally to relatively high investment.

The present invention is intended to improve the situation.

The invention proposes a throttle device for an aircraft turbine engine of the type comprising a control assembly able to act on the native command system of the turbine engine as a function of a manual input defined by a pilot control element, in which the pilot control element is designed to provide a lever angular position signal in the form of a voltage, in particular a continuous voltage.

According to a main characteristic of the invention the control assembly comprises:

- an automatic device able to convert the lever angular position signal into a transformed angular position signal as a function of a selected command law, and
- at least one interface able to convert the transformed angular position signal into two sinusoidal signals, in particular of the resolver type, which allows pilot control by the same device of different turbine aero engines, in particular turbine engines with native command by sinusoidal type signals.

According to an advantageous characteristic of the invention the device also comprises an actuator module able to receive as an input the transformed angular position signal and supply as an output a native command for turbine engines with hydromechanical drive, the automatic device being able to trigger the actuator module comprising a engine and a reducing gear. Preferably the actuator module is able to act electromechanically on a lever of a regulator of a turbine engine with hydromechanical drive and furthermore the automatic device is able to control the lever of the actuator module.

As an option, from an excitation signal transmitted by a turbine engine regulator, the interface is able to convert a transformed angular position signal into two sinusoidal signals transmitted to the regulator of the turbine engine which has native command by sinusoidal type signals.

Advantageously the transformed angular position signal comprises either a linear signal or two trigonometric signals.

Figure 2:
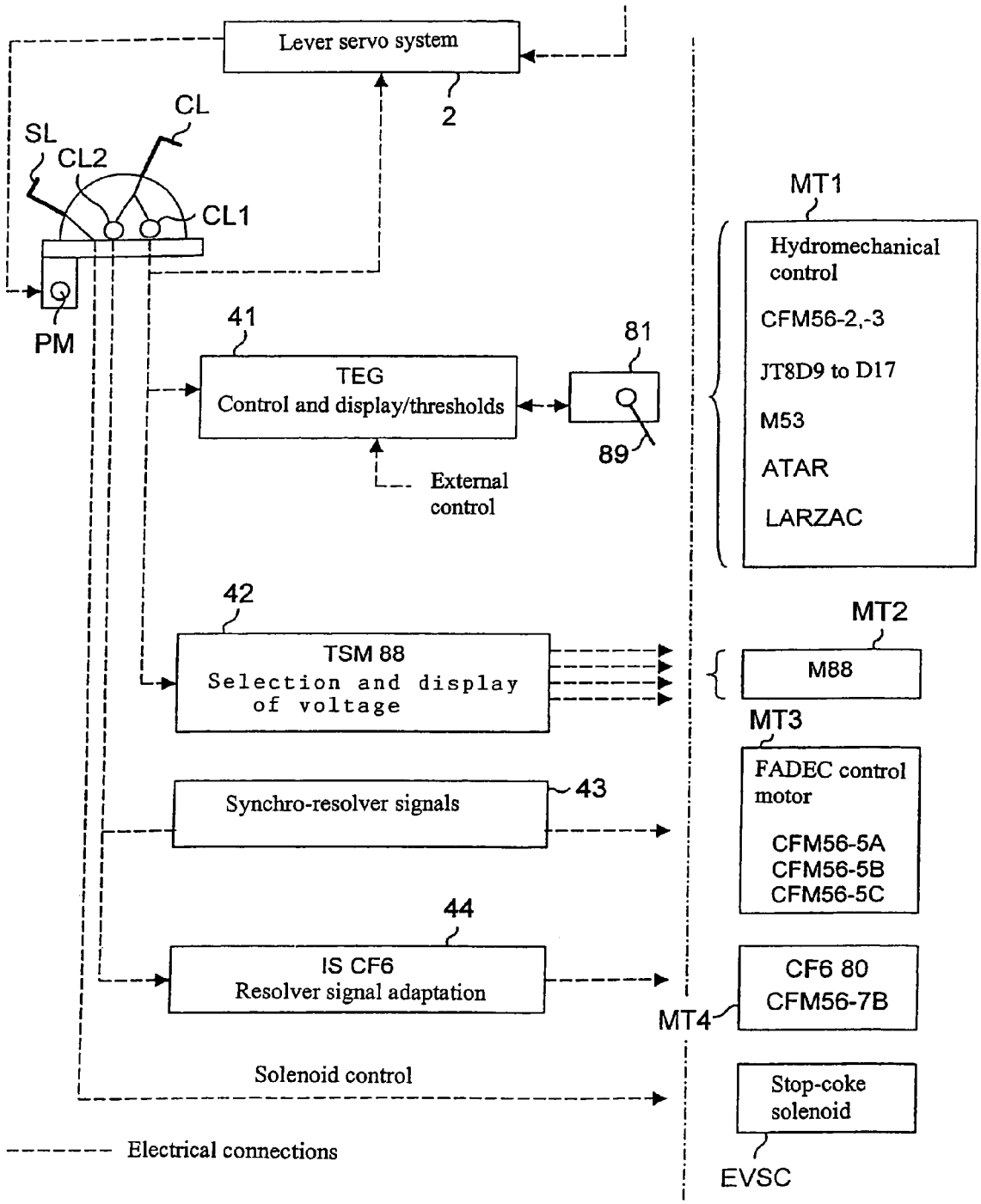
Figure 3:
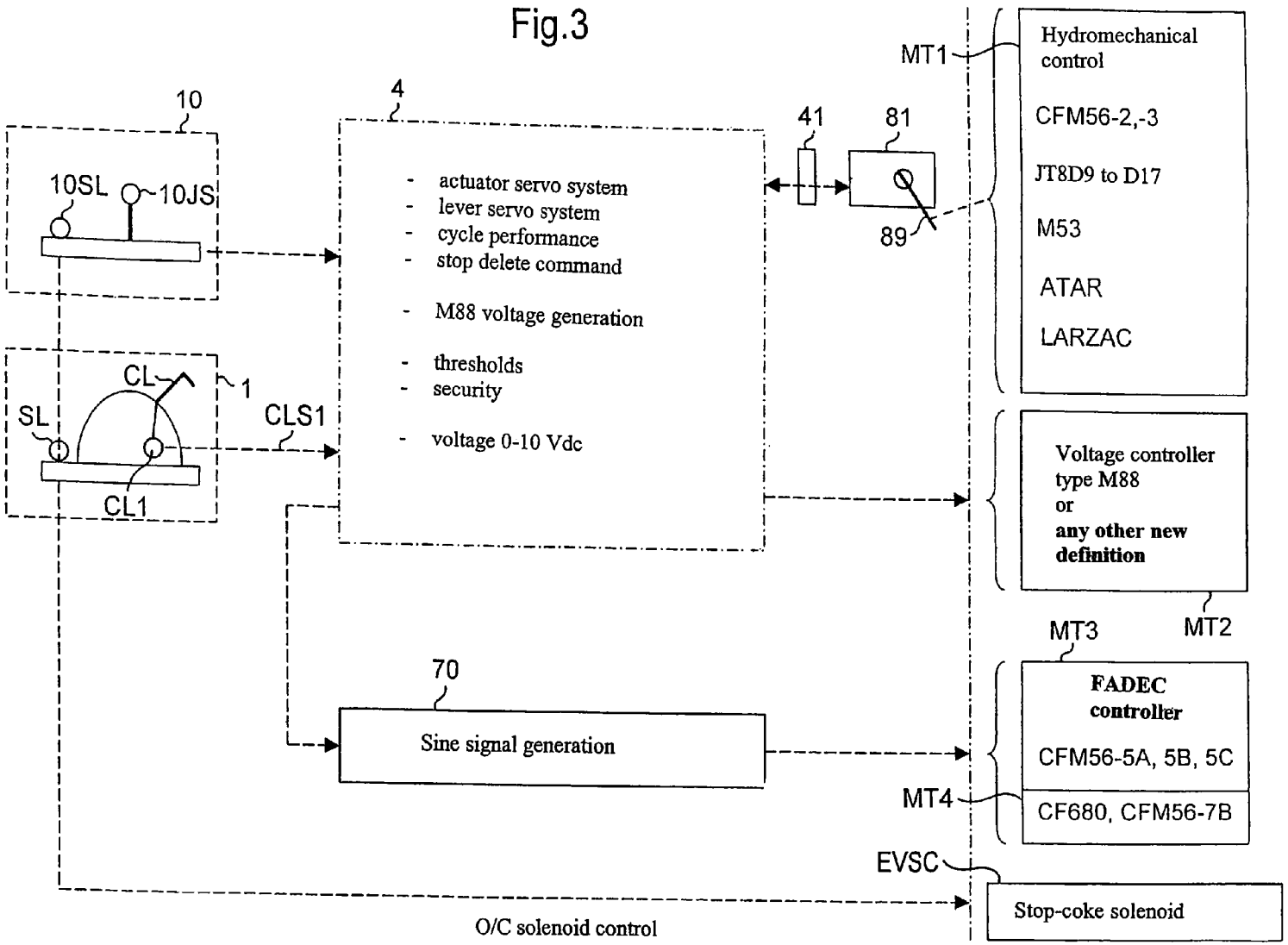
Figure 4:
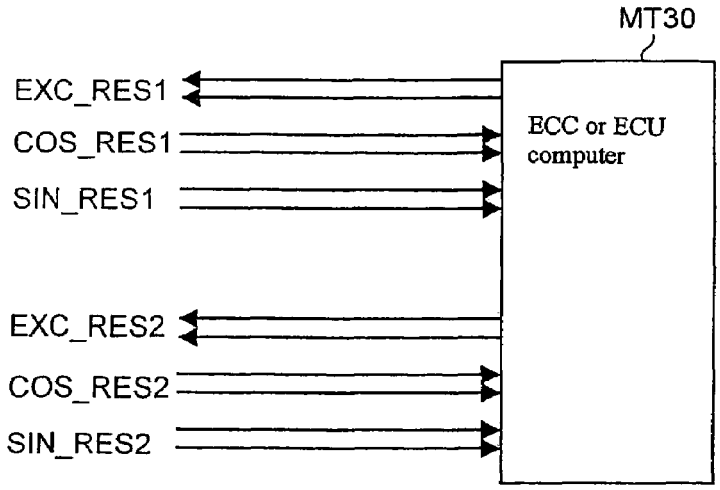
Figure 5:
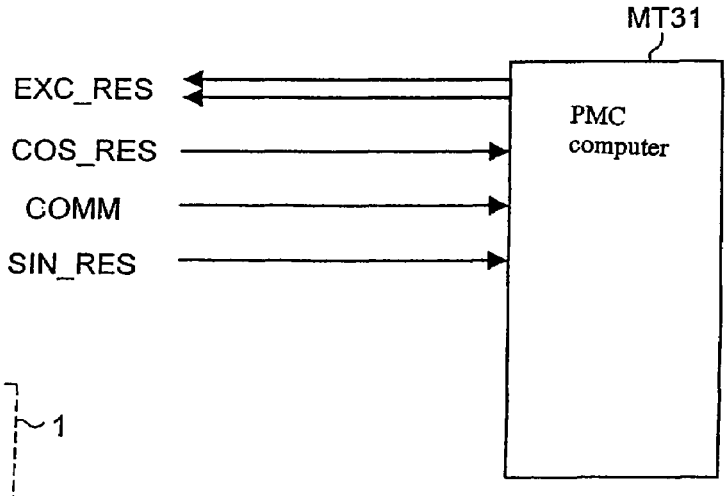
Figure 6:
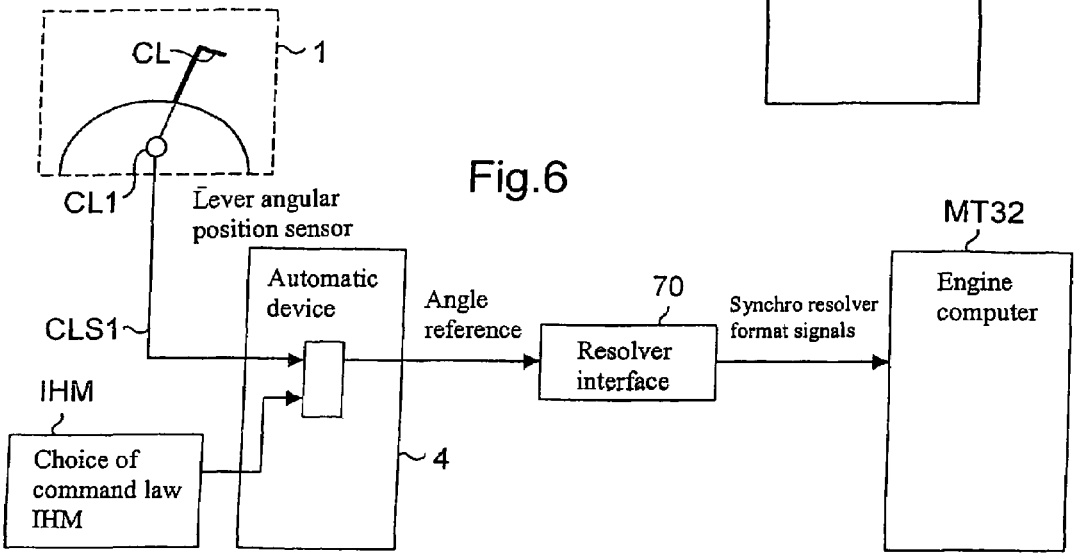
Figure 9:
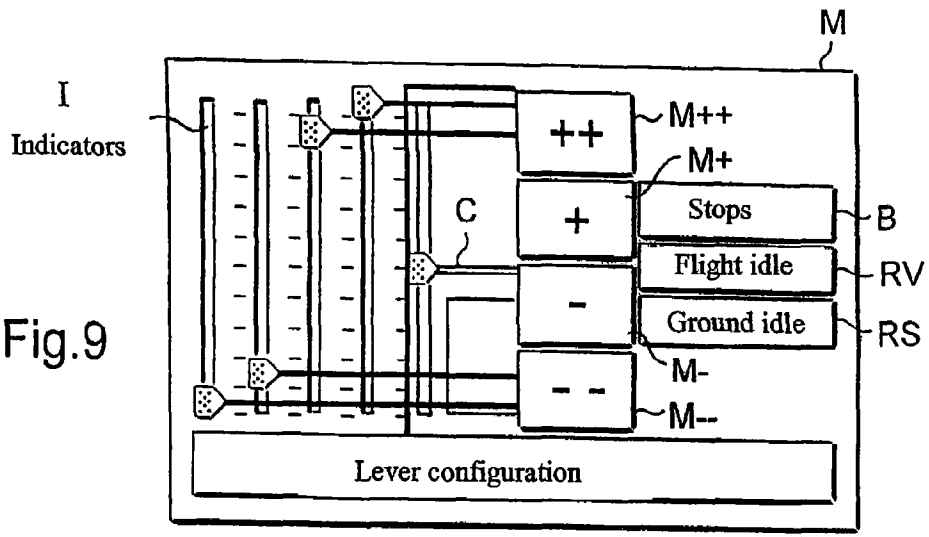
Figure 10:
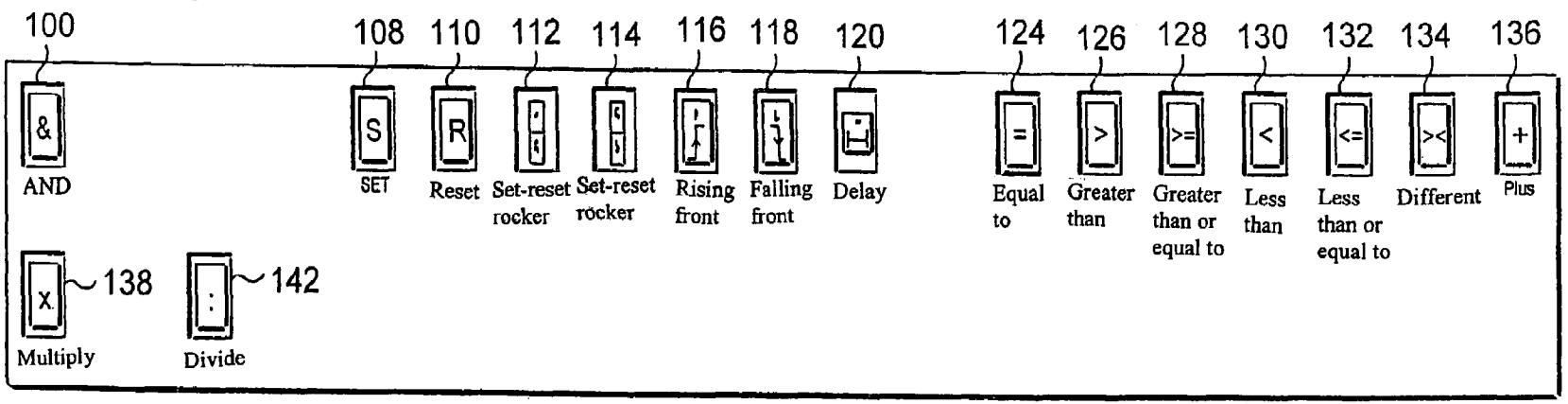
Figure 16:
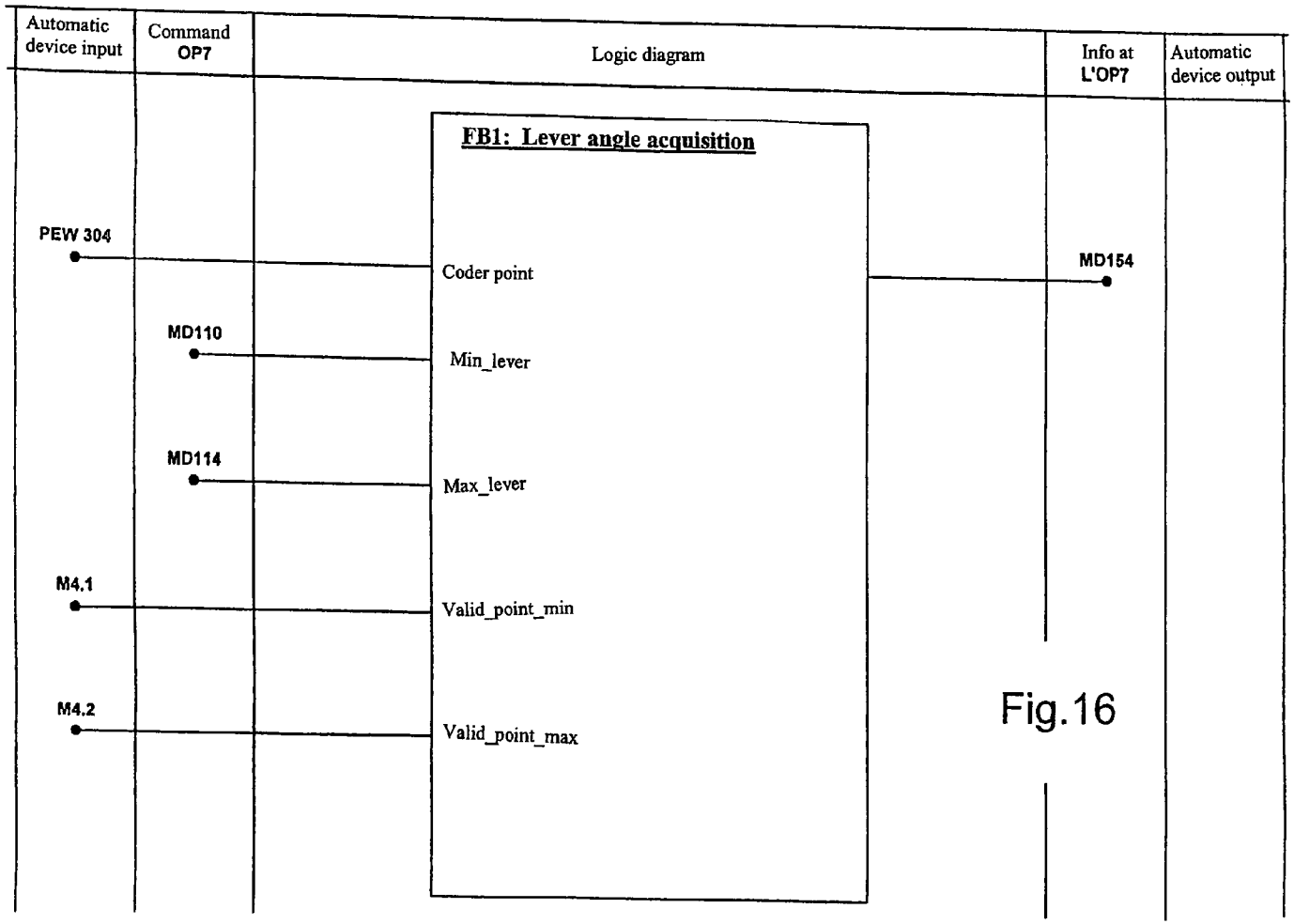

Other characteristics and advantages of the invention will appear from the detailed description below and the attached drawings in which:

FIG. 1 is a principle diagram of a test bench able to work on various types of engine illustrated, FIG. 2 is the principle diagram of FIG. 1 in more detail, FIG. 3 shows the principle diagram of a test bench according to the invention able to work with various types of engine, FIG. 4 shows diagrammatically the exchange of signals between a sinusoidal signal generator of a test bench according to the invention and a first type of computer, FIG. 5 shows diagrammatically the exchange of signals between a sinusoidal signal generator of a test bench according to the invention and a second type of computer, FIG. 6 shows diagrammatically the principle of a test bench according to the invention able to work with an engine working from sinusoidal signals, and FIG. 7 shows diagrammatically a sinusoidal signal generator of the test bench according to the invention able to work with the second type of computer in FIG. 4, FIG. 8 shows diagrammatically the principle of a test bench according to the invention comprising an operator interface, FIG. 9 shows diagrammatically a design of operator interface according to the invention, FIG. 10 shows the legend of the terminals used in the logic diagrams of the logic circuits of the automatic device in FIGS. 11 to 20, FIGS. 11-A to 11-C illustrate in the form of logic diagrams the logic circuits of the automatic device allowing recovery of operator demands, FIGS. 12-A to 12-B illustrate in the form of logic diagrams other logic circuits of the automatic device allowing recovery of operator demands, FIGS. 13-A to 13-B illustrate in the form of logic diagrams the logic circuits of the automatic device allowing fault management, FIGS. 14-A and 14-E illustrate in the form of logic diagrams five logic circuits of the automatic device allowing the recovery of engine parameters, FIGS. 15-A and 15-B illustrate in the form of logic diagrams the first logic circuits of the automatic device allowing the recovery of minimum and maximum lever angles for a selected engine, FIGS. 16 shows in the form of a logic diagram a second logic circuit of the automatic device allowing recovery of the lever angle from the lever potentiometer signal, FIGS. 17-A to 17-C illustrate in the form of logic diagrams three logic circuits of the automatic device allowing output calculation of the lever angle in degrees and/or radians, FIGS. 18-A to 18-D illustrate in the form of logic diagrams the logic circuits of the automatic device allowing calculation and scaling of the cosine and sine from the outputs of FIGS. 17, FIGS. 19-A and 19-B illustrate in the form of logic diagrams two logic circuits of the automatic device allowing copying of the engine command in the scale of the engine law and copying of the scaled engine command in a given scale for an ACQ acquisition system, FIGS. 20-A to 20-G illustrate in the form of logic diagrams the logic circuits for the automatic device allowing the issue of analog outputs of the device in particular for a redundant computer.

The attached drawings not only serve to complete the invention but also contribute to its definition where applicable.

We are interested here in a modular assembly allowing pilot control of the reactor throttles (electric or electromechanical drive). The throttle control can take place in three ways depending on the regulator type of the reactor:

- by actuator: electromechanical drive of the reactor regulator control lever,
- by electric sinusoidal signals of the synchro-resolver type applied directly to the reactor computers,
- or by voltage generation: specific laws applied to the reactor computers.

FIG. 1 shows a principle diagram of a test bench able to work with various types of engine as shown. FIG. 2 is the same principle diagram in slightly more detail but without showing the engines.

The devices in FIGS. 1 and 2 are part of an installation as used until now by the Applicant and which will now be described.

Reference 1 designates the pilot control element available to the operator performing tests on an engine. This pilot control element here comprises:

a lever CL which performs the actual throttle control, and another lever SL which shuts off the fuel supply to the engine, which is generally performed by a "stop coke" solenoid valve incorporated in any civil engine.

As a variant or in addition the pilot control element can comprise a physical lever PM for the actual throttle control. In the known device this lever PM acts on the lever CL via a position servo-mechanism 2 known as the "lever servo".

Associated with the lever CL is an angular position sensor CL1 of the potentiometer type. This angular position or its copy is transmitted electrically in the form of an analog position signal CLS1, in particular a signal of continuous potentiometric voltage, to a control assembly 4 which will be discussed later.

Also associated with lever CL can be another angle sensor CL2 of the resolver type which in turn supplies CLS2 signals of the sinusoidal-resolver type representing the position of lever CL in a different way. These signals are then transmitted or not through a forming module depending on the type of reactor, then transmitted to the computer.

In aircraft reactors which are referred to here as engines there are various throttle control modes (also known as the laws) as a function in particular of the aircraft class concerned, the reactor generation concerned in these classes, and the manufacturer.

Reference MT1 designates an engine with throttle control by hydromechanical regulation. This may be one of the following engines: CFM56-2, CFM56-3, JT8D9 to JT8D17, M53, ATAR, LARZAC, all manufactured by the Applicant. The input element for the throttle control on the engine side is then a lever 89. In this case the control assembly 4 comprises an electronic rack unit 41 (TEG) which acts on an actuator 81 which in turn controls the lever 89.

An "electronic rack unit" is a module which takes the form of a rack unit holding electronic racks which is able to act on means of the type actuator, regulator or other.

Reference MT2 designates an engine with throttle control via electric voltages, as for example model M88 by the Applicant. In this case the control assembly 4 comprises a specific rack unit for this engine 42 (TSM88) which is responsible for supplying adequate voltages.

Reference MT3 designates an engine with throttle control by synchro-resolver type signals, in particular for a "FADEC" regulator (Full Authority Digital Engine Control), such as for example engines CFM56-5A/5B/5C. Such engines can operate either in ECU mode (Engine Control Unit) or in EEC mode (Electronic Engine Control). The FADEC regulator by its principle involves a redundant computer.

Reference MT3 also covers engines for which the control computer is not redundant such as PMC computers (Power Management Control), for example engine CF6 80 C2 PMC/PMUX.

In the case of a engine of type MT3, the control assembly 4 comprises a stage 43 which can operate by simple copying of signal CLS2 from lever CL, insofar as this also has an output of the synchro-resolver type.

Reference MT4 designates an engine with throttle control via synchro-resolver signals such as for example engine CF6 80 E1 FADEC, CF680 C2 FADEC or CFM 56-7B by the Applicant.

In this case the control assembly 4 comprises a specific interface 44 (ISCF6), which can operate by adapting the signals from the lever CL insofar as this has an output of the synchro-resolver type.

In practice elements 1 to 4 (except 89) are placed in the control room. Where applicable the actuator 89 is placed on or next to the reactor.

The pilot throttle lever CL should allow the following functions, some of which have already been listed:

production of an electronic signal as a function of the lever angle, transmission of control signals by two synchro-resolver signals to the reactor computers (FADEC), adjustable stops allowing positioning of the lever at precise angles (idle, full gas, post combustion in particular), gate allowing stop deletion (on rapid acceleration for example), lever travel control by fine adjustment (demultiplication), fuel cut-off control lever (for stop-coke solenoid control).

In the assembly 4 the element concerned amongst 41 to 44:

receives the electrical signal from the pilot lever and displays the actuator angle, supplies adjustable thresholds (dry contacts) as a function of the lever angle, triggers the actuator, issues a signal copying the actuator position (0–10 VDC), where applicable receives an external command to pilot the actuator by signal 0–10 VDC (instead of the lever), allows adjustment of the pilot lever and actuator references (zero degree adjustment) and performs adjustments (gain, max actuator intensity, thresholds etc), controls the return to idle of the actuator on actuator excess torque, controls the remote actuator reset at pilot request.

Finally, the actuator comprising a engine and a reducing gear:

allows control of reactors with hydromechanical regulation by electromechanical action on the reactor regulator lever, when necessary returns the reactor lever to the idle position (safety), on pilot request from the servo-mechanical and power rack unit, on electrical interruption of the actuator supply or again on detection of excess torque.

Various actuator versions are possible depending on the reactor types (in particular: deflection, engine torque and idle return torque).

As an option (shown on FIGS. 1 and 2) the following can be provided:

an electronic rack unit for the motorisation of the throttle lever (control of pilot throttle lever) allowing cycling (or automatic piloting) while leaving the pilot the option to resume control of the reactor at any time, a specific electronic rack unit for generations of M88 laws with monitoring and display of output voltages.

It is also necessary to specify a control law: in fact there is no reason why a given engine should obey the pilot control element in the same way as another engine of the same category or another category.

Thus:

the rack unit 41 comprises an external command input for threshold adjustment and display, as a tool dedicated to engine M88, the specific rack unit 42 can be intrinsically adapted to this engine, similarly stage 43 can be defined a priori for the FADEC type regulator, finally interface 44 can also be intrinsically adapted to engine CF6.

The precision of the command law is important. In fact any imprecision in the chain of command can be reflected in damage or even destruction of the engine, which is not generally the desired result of testing.

Elements 41 to 44 can be implemented as follows:

the rack unit 41 comprises a servo-mechanism rack in the position of actuator 81, the specific rack unit 42 comprises a specific rack M88 allowing demultiplication of the control voltage into four analog engine signals, in the embodiment described, stage 43 is a simple transmission of the signals issuing from the lever LC, interface 44 comprises a rack allowing shifting of the throttle law adapted to the engine law.

The installation in FIGS. 1 and 2 offers various interesting possibilities:

Keep the pilot throttle lever in its position by adjustable brake;

Ergonomics of the pilot throttle lever similar to that found on the aircraft: robustness and manoeuvring;

Safety functions such as automatic idle return integrated in the actuator on detection of excess torque or on external command (pilot control on the servo-mechanism rack unit or on the dry contact like a push button activated by the pilot);

Emergency supply 28 Volts for the assembly.

But it also offers significant drawbacks linked to the type of reactor to be processed:

high modularity depending on reactor type, i.e. the installation in particular in assembly 4 comprises elements which increase in number with the growing number of different types of reactor to be processed, little flexibility of development as new adaptations must be implemented whenever a new type of reactor is to be processed.

The result is very high investment, in particular as the number of reactors or engines to be processed increases.

Also it is now desirable to be able to perform endurance cycles in automatic mode (requirements of functional Pilot Specifications). Cycles can be implemented by adding a "motorisation rack unit" option. The result is again a high cost, difficult implementation and maintenance, and low reliability due to the multiplication of specific rack units.

In a detailed study, the Applicant observed that it is possible (FIG. 3), instead of the diversity of modules shown in FIGS. 1 and 2, to arrange the same functions around a control module (4) comprising an automatic device which is able to create an adequate link between:

the operator variable defined by the pilot control element, and the actuator variable received by the engine processed, taking into account the command law specified for the given engine.

The automatic device 4 can function with a piloting module 1 similar to the pilot control element 1 of FIGS. 1 and 2 but without it being necessary to incorporate additional sensor CL2 which issues the resolver signals.

The automatic device 4 can also function with a digital piloting module 10 actuated by a lever or mini-joystick 10JS. Preferably a button 10SL is associated with this to control the fuel shut-off.

If both the piloting module 1 and the digital piloting module 10 are provided, buttons SL and 10SL can be paralleled. The stop-coke solenoid (not shown) can be regarded as common to all civil engines under test.

On FIG. 3 an analog angle output from the automatic device 4 goes to a sinusoidal signal generator (resolver) 70 (which could be regarded as included in the automatic device 4).

The production of the resolver signals is in fact one of the difficulties encountered when producing a "universal" piloting system i.e. able to work with a large variety of "native" engine throttle systems.

According to FIG. 6, at the output of the piloting module 1 (or 10), a lever angular position signal CLS1 in the form of a continuous voltage for example is supplied to the automatic device 4. The latter transforms this signal into a transformed angular position signal as explained below. This transformation comprises in particular:

application of an engine command law which can be selected by the operator or via an operator interface, for example the IHM operator interface developed below, adaptation of the physical lever deflection angular range TLA (from −90° to +90°) into an angle TRA for the computer (for example 38° to 85.5°).

This transformed angular position TRA is also called the angle reference signal at the automatic device output. The signal is sent to the sinusoidal signal generator 70 also referred to as the "resolver interface". This "resolver interface" allows generation, from an angle reference signal, of two resolver sinusoidal signals for an engine regulator MT3, more particularly for the computer MT32 of this engine regulator.

The following notation is used:

"TRA" ("Throttle Resolver Angle") designates generically the throttle angle reference value, "TRA_DC10" designates an analog signal from 0 to 10 Volt representing the angle TRA over a range of −90° to +90° for example, "TRA_Sin10" and "TRA_Cos10" designate two analog signals each ranging from 0 to +10 Volt and representing respectively the sine and cosine of the TRA angle over a range from −1 to 1, these signals allowing working in an angle range from 0° to 180°, "TLA" indicates the throttle lever angle value.

It is recalled that a "FADEC" type regulator in principle involves a redundant computer in an engine which can operate either in ECU mode or in EEC mode. On FIG. 4 the corresponding input interface on the engine side marked MT30 has two tracks:

a track 1 actuated by despatch from MT30 of an excitation signal EXC_RES1, sinusoidal, ready to receive two signals COS_RES1 and SIN_RES1 modulating the signal EXC_RES1 as a function of the cosine and sine of angle TRA respectively, to within a factor;

a track 2 which does the same thing in redundancy with excitation signals EXC-RES2 and return signals COS-RES2 and SIN_RES2.

This redundancy fulfils a requirement for security and safety.

Typically we have:

EXC_RESi: 7.07 Volt (±2.0%) at 3000 Hz (±10%)

K=0.492 (±0.025%)

EXC_SINi=L*EXC_RESi*sin(TRA)

EXC_COSi=K*EXC_RESi*cos(TRA)

FIG. 7 shows more particularly the housing of the resolver interface intended to work with a redundant signal regulator. Thus this terminal has two resolver interfaces 70-1 and 70-2 each receiving in input the angle reference signal from the automatic device. The latter comprises two analog outputs each linked to a different resolver interface.

In the case of an engine with PMC computer (FIG. 5) there is no redundancy. The function is similar with excitation signals EXC_RES and return signals COS_RES and SIN_RES, accompanied by a common lead linked to earth marked COMM.

Typically we have:

EXC_RES: 7.07 Volt (±2.0%) at 3000 Hz (±10%)

EXC_SIN=EXC_RES*sin(TRA)

EXC_COS=EXC_RES*cos(TRA)

If the output reference signal from the automatic device is a linear signal of the type "TRA_DC10", the resolver interface 70 scales this signal to −90°, +90° and supplies sinusoidal signals of the type EXC_SINi=K*EXC_RESi*sin(TRA-DC10 scaled)

EXC_COSi=K*EXC_RESi*cos(TRA-DC10 scaled).

The resolver interface receiving a linear analog type signal (such as a continuous voltage) can be created using:

known synchro/resolver signal simulators, or a central unit associated with a digital/resolver conversion card following a standard format (for example VMW, VXI, PCI, ISA . . . ) or specialist components in the measurement field performing the functions of digital/resolver and analog/resolver conversion, these components existing in various forms (monolithic, hybrid, module).

These simulators, cards or components are provided by American companies such as Data Device Corporation, North Atlantic Instrument, Computer Conversion Corporation.

If the output reference signal from the automatic device is a pair of trigonometric signals type "TRA_Sin10" and "TRA_Cos10", the resolver interface 70 scales these −1 to 1 and provides sinusoidal signals of type EXC_SINi=K*EXC_RESi*(TRA_Sin10 scaled)

EXC_COSi=K*EXC_RESi*(TRA_Cos10 scaled).

The resolver interface receiving two trigonometric type signals may be an electronic card comprising conventional components performing the functions of analog signal multiplication.

As indicated above, it is possible for an operator to select an engine control law i.e. select an engine to which is linked an angular range which allows scaling of the input signal of the automatic device 4. To do this the automatic device 4 is linked to a man machine interface IHM as indicated on FIG. 6 and developed on FIG. 8. This interface also serves for dynamic display of the parameter values and the signals of the control device. As shown on FIG. 8 this interface can be a screen on which is shown for example a window M for the lever using an "applet" application. The window displays data such as the lever angular position corresponding to signal CLS1 given to the automatic device, the value of the lever angle reference signal, the position of the lever stops defined as:

ground idle stop, flight idle stop, threshold 1 stop such as take-off stop TAOF (take off), threshold 2 stop such as continuous flight stop MXCT (max continuous).

This man machine interface also allows changes in the lever angular position by sending appropriate commands to the automatic device. For this the operator can click on virtual buttons M++, M+, M− and M−− shown on screen in order to increase or reduce the lever angular position from a value displayed on screen. He can also enter the value of the desired angular position direct. Virtual button M++ has an increment pitch (or slope) which is greater than the increment pitch of virtual button M+. The same applies to buttons M− and M−−.

FIG. 9 shows other virtual buttons attributed to the action of moving the lever to the Flight Idle stop (virtual button RV), the action of moving the lever to the Ground Idle stop (virtual button RS), indication of the fact that the operator has jumped the stop (virtual button B). On FIG. 9 the positions of indicators I which can move on graduated scales indicate the values of the four stops. The operator can click on the virtual buttons M++, M+, M− and M−− shown on screen in order to increase or diminish the current reference C. The ground idle and flight idle values can also be modified from the same manoeuvres by the operator.

Naturally these values are sent to the automatic device 4 by a PC type computer known as a federator and used as a link between the automatic device and the pilot screen. The automatic device 4 transmits these values to the physical lever 1.

The operator can thus select and add a command law input and modify the parameters of the pilot control element.

The parameters of the pilot control element comprise the deflection of the pilot control element, the position of the lever stops, the desired angular position value, the acceleration per angular unit and the deceleration per angular unit associated either with the angular input by the operator or the virtual buttons M++, M+, M− and M−− (which corresponds to the increment pitch) or to the position of each stop.

Selection of the engine command law by the operator means selection of the desired type of engine (or turbine engine). According to FIG. 8 the selected engine allows the expected signal type to be sent to an electronic rack unit, the rack unit 41 then being able to act on the actuator 81.

FIGS. 11 to 22 illustrate an example of implementation of the automatic device in the form of logic circuits. The man-machine interface of the operator console type, for example a graphic interface linked to the automatic device, allows the operator to enter data to perform tests on a selected engine on the test bench. This graphic interface also allows the operator to monitor the development of the current test.

FIG. 10 shows the significance of the symbols used in the logic circuits of FIGS. 11 to 22.

Symbol 100 associates two inputs into one output signal. The symbol 108 depicts resetting the input signal to 1. Symbol 110 depicts setting the input signal to 0. Symbols 112 and 114 depict logic trigger circuits. Symbols 114 and 116 depict a trigger on a rising front and on a falling front of a signal. Symbol 120 depicts a signal time delay. Symbol 124 depicts the equivalence between the input signal and the output signal. Symbol 126 verifies the superiority between a main signal and a value and gives the main signal as the output signal. Symbol 128 verifies the superiority or equality between a main signal and a value and gives the main signal as the output signal. Symbol 130 verifies the inferiority between a main signal and a value and gives the main signal as the output signal. Symbol 132 verifies the inferiority or equality between a main signal and a value and gives the main signal as an output signal. Symbol 134 verifies the difference between the main signal and a value and gives the main signal as an output signal. Symbol 136 adds two input signals and gives a corresponding output signal. Symbol 138 multiplies two input signals and gives a corresponding output signal. Symbol 142 divides two input signals and gives the corresponding output signal. Abbreviations are also used to designate the logic circuit such as the term MOVE which designates an instruction to copy from one memory to another memory.

The figures consist of various columns which depict the inputs to the automatic device EA, the outputs from the automatic device SA, the input commands from the graphic interface EOP corresponding to an input of data by an operator, the output of data from the graphic interface IOP corresponding to presentation of outputs of logic circuits of the automatic device, for example by data display. Inputs and outputs EA, SA, EOP and IOP are designated by abbreviations attached to an identification number. These abbreviations can designate:

MW: a complete word of 16 bits

M: a bit within the circuit

E: an all or nothing input

MD: a double word.

In general an operator who wishes to perform a test, must select an engine from the engines offered, enter and validate the minimum and maximum lever angles and start the test.

A fault may occur. The automatic device comprises specific circuits for signals which detect faults. For example FIGS. 13-A and 13-B respectively illustrate the voltage fault detection circuits at cards 1 and 2 of the automatic device. Input E0.0 or E0.1 of the automatic device is activated as soon as a voltage fault is detected at the level of card 1 and card 2 respectively. These logic circuits give a signal at outputs M153.0 and M153.1 of the automatic device warning of current faults. Other logic circuits allow detection of faults specific to the automatic device.

During the test if a fault occurs the outputs are forced to 0 and the test moves to fault status. FIG. 11-A shows an acknowledgement of fault by the operator who enters command MW104. The information of the fault acknowledgement is presented by the graphic interface (MW104 and MW152) and output M4.0 of the automatic device resumes the test and allows its recovery. The MOVE boxes are instructions to copy from one memory to another memory, here to copy information for a display on screen.

FIG. 11-B shows the acquisition of a minimum lever angle. The operator enters a minimum lever angle value to be applied between 0° and 360° (command MW108). This value must be different from 0 and is associated with a mean value MW150 which must be different from 256 to validate the minimum lever angle value. The voltage signal at output M4.1 of the automatic device represents the validation of the minimum lever angle input.

FIG. 11-C shows the acquisition of a maximum lever angle. The operator enters a maximum lever angle value to be applied between 0° and 360° (command MW106). This value must be different from 0 and is associated with a mean value MW150 which must be different from 256 to validate the maximum lever angle value. The voltage signal at output M4.2 of the automatic device represents the validation of the maximum lever angle input.

FIGS. 12-A and 12-B show logic circuits allowing display on the graphic interface of value MW 106 of the maximum lever angle and value MW 108 of the minimum lever angle once validated as shown on FIGS. 11-B and 11-C. Values 0 at the input of the MOVE boxes serve for initialisation.

The angular deflection of the lever corresponds to a "lever law". This deflection is selected as described above by the user.

FIGS. 14-A to 14-E each show a logic circuit used for one of the five engines which the operator can select using command MW100.

The choice of engine can only be made when the status of the test is stopped: the value of the Go/Stop command MW 102 is 0 when the status is stop, a value which can be modified by operator input.

Command MW100 can also be an integer from one 1 to 5 to designate the engine selected by the operator, the engines being numbered 1 to 5 in the examples of FIGS. 14. Once the engine has been chosen, the operator can enter the minimum and maximum values of the angular range of the engine selected, the angular range varying from −360° to 360°. These commands are MD170 and MD174 for engine 1, MD180 and MD184 for engine 2, MD 190 and MD194 for engine 3, MD200 and MD204 for engine 4, MD210 and MD214 for engine 5. The angular range linked to the choice of engine is called the "engine command law" or "engine law".

The Go/Stop command MW 102 is set to 1. The logic circuits at which MW 100=1 is activated.

From the minimum and maximum angle values of an engine selected at stop status, the automatic device presents at output voltage values MD158 and MD162 associated with the minimum and maximum angle values of the selected engine.

The voltage values MD158 and MD162 corresponding to the minimum and maximum angle values of the engine selected are used in inputs via the automatic device on FIGS. 15-A and 15-B. These voltages values are copied to the memory by the MOVE box which obtains voltage values corresponding to the fictitious values of the minimum and maximum lever angles MD110 and MD114 for the engine selected. Thus the angular range of the lever is modified as a function of the engine selected and the associated command law.

Once the test has started, after selecting the engine and its parameters, FIG. 16 shows the function of the automatic device allowing display of the reference of the lever angle in progress. The automatic device receives in input:

- value PEW304 corresponding to a voltage value given by the potentiometer and associated with the current value for the lever angle,
- voltage value M4.1 corresponding to the value of the minimum lever angle acquired by the logic circuit in FIG. 11-B,
- voltage value M4.2 corresponding to the value of the maximum lever angle acquired by the logic circuit in FIG. 1-C,
- voltage values MD110 and MD114 corresponding to the fictitious minimum and maximum lever angles for the engine selected as recovered by the logic circuits of FIGS. 15-A and 15-B.

The logic circuit of the automatic device in FIG. 16 converts the lever potentiometer voltage value PEW 304 to a voltage value MD154 corresponding to the current lever angle. This conversion is performed from the potentiometer voltage range, voltage values corresponding to the values of the actual maximum and minimum lever angles, voltage values corresponding to the fictitious values of the maximum and minimum lever angles MD110 and MD114 for the selected engine.

FIGS. 17-A to 17-C show logic circuits leading to calculation of the reference angle in degrees then in radians.

FIG. 17-A corresponds to an initialisation circuit before calculation of the new reference angle. Output MD20 is a voltage representing a value in degrees.

On FIG. 17-B the logic circuit of the automatic device receives in input:

the value of command MW102 which must be equal to 1 (signifying that the test status is stopped), the voltage values corresponding to the values of the fictitious minimum and maximum lever angles MD110 and MD114 for the selected engine, the voltage values corresponding to the values of the minimum and maximum angles MD158 and MD162 of the engine selected, the voltage value of the current lever angle MD154.

The logic circuit in FIG. 17-B gives as output the value of the lever angle in degrees MD20.

FIG. 17-C illustrates conversion of the value MD20 into an angle in radians MD24 by multiplication by a factor $\pi/180$.

The automatic device as indicated in the description above may provide at the resolver interface a reference angle value which is then transformed into two sine and cosine values. It is also possible to provide an the automatic device which issues as output value the sine and cosine of the reference angle.

FIGS. 18 show an automatic device offering at the output the sine and cosine of the lever reference angle.

Thus on FIG. 18-A the value of the angle in radians MD24 of the lever reference is given as input to the logic circuit COS which transforms this value into a value MD30 of the cosine of this angle at the output from the logic circuit. On FIG. 18-B this value MD30 is the input to the scaling logic circuit FC106, values 1 and −1 in input represent the upper and lower limits of the input signal. Value M3.0 is a validation bit always at 1 which serves to validate the call of the logic circuit FC106. The scaled cosine value MW36 is given at the output from the automatic device, output MW34 indicates the status of scaling of the cosine.

Thus on FIG. 18-C the value of the angle in radians MD24 of the lever reference is given as input to the logic circuit SIN which transforms this value into a value MD40 of the sine of this angle at the output from the logic circuit. On FIG. 18-D this value MD40 is the input to the scaling logic circuit, values 1 and −1 in input represent the upper and lower limits of the input signal. Value M3.0 is a validation bit always at 1 which serves to validate the call of the logic circuit FC 106. The scaled sine value MW46 is given at the output from the automatic device, output MW44 indicates the status of scaling of the sine.

FIGS. 19 illustrate the logic circuits for the scaling for the outputs of angle values in degrees MD20 of the logic circuits of FIGS. 17-A and 17-B.

From the input MD20 representing the reference angle value in degrees, the logic circuit in FIG. 19-A receives as the upper and lower limits of the input signal voltage values corresponding to the minimum and maximum angles MD 158 and MD 162 of the selected engine (angular range of the engine law). Signal M3.1 in input is always zero. From these inputs the logic circuit in 19-A allows copying of the reference to the angular range of the engine law for the acquisition system ACQ known as output MW56 and simple copying of the reference to the angular range of the engine law known as output MW54.

From input MD20 representing the reference angle value in degrees, the logic circuit in FIG. 19-B receives as the upper and lower limits of the input signal, values 140° and 40°, merely as an example. Signal M3.1 in input is always zero. From these inputs the logic circuit in FIG. 19-B allows copying of the reference to the angular range of the engine law for the acquisition system ACQ known as output MW60 and simple copying of the reference to the angle range of the engine law known as output MW58.

FIGS. 20 allow allocation of words internal to the automatic device to the analog outputs of the device. FIGS. 20-A, 20-B and 20-C are redundant respectively with FIGS. 20-E, 20-F, 20-G so that the outputs of the automatic device are redundant for a resolver interface as shown in FIG. 7.

If the automatic device proposes in output a first trigonometric signal, the circuit of FIG. 20-A offers, from input MW46 representing the sine of the reference angle, an output PAW272 as a first output of the sine of the reference angle at the resolver interface. The circuit 20-E is the redundancy of the circuit in FIG. 20-A and offers an output PAW288 as the second output of the sine of the reference angle at the resolver interface.

If the automatic device proposes in output a second trigonometric signal, the circuit of FIG. 20-B offers, from input MW36 representing the cosine of the reference angle, an output PAW274 of the first output of the cosine of the reference angle at the resolver interface. The circuit 20-F is the redundancy of the circuit in FIG. 20-B and offers an output PAW290 as the second output of the cosine of the reference angle at the resolver interface. If the automatic device proposes in output a linear signal, the logic circuit of FIG. 20-C allows the supply in output of a copy of the engine command in the scale of the engine law for the acquisition system ACQ from input MW56 (of FIG. 19-A) corresponding to the reference angle scaled in the engine law.

The logic circuit of FIG. 20-G allows the supply in output of a copy of the engine command in the scale [40°, 140°] for the acquisition system ACQ from input MW60 (of FIG. 19-B) corresponding to the scaled reference angle.

The logic circuit in FIG. 20-D allows the supply at terminal 41 (power servo-amplifier) of FIG. 3, voltage signals PAW278 and PAW294. Signal PAW278 corresponds to the signal of the lever potentiometer voltage PEW 304, signal PAW 294 corresponds to half the signal PEW304 of the lever potentiometer voltage.

The invention is not limited to the embodiments described above, merely as an example, but includes all variants which could be considered by the person skilled in the art.

The invention claimed is:

1. A throttle control device for an aircraft turbine engine comprising a control assembly able to act on the native command of the turbine engine as a function of a manual input defined by a pilot control element, in which the pilot control element is designed to give a lever angular position signal in the form of a voltage, wherein the control assembly comprises:

an automatic device able to convert the lever angular position signal into a transformed angular position signal, as a function of a selected command law, and at least one interface able to convert the transformed angular position signal into two sinusoidal signals which allows control of different turbine engines by a same device.

2. The device according to claim 1, further comprising an actuator module able to receive as input the transformed angular position signal and supply as output a native command for turbine engines with hydromechanical control, the automatic device being adapted to control the actuator module comprising an engine and a reducing gear.

3. The device according to claim 2, wherein the actuator module is able to act electromechanically on a lever of a regulator of a turbine engine with hydromechanical control and the automatic device is adapted to control the actuator module lever.

4. The device according to claim 1, wherein the interface is able, from an excitation signal transmitted by a regulator of a turbine engine, to convert a transformed angular position signal into two sinusoidal signals sent to the regulator of the turbine engine which has native command by sinusoidal type signals.

5. The device according to claim 4, wherein the transformed angular position signal comprises either a linear signal or two trigonometric signals.

6. The device according to claim 4, wherein the automatic device is able to supply at least two transformed angular position signals at the interface the interface being adapted to supply at least four sinusoidal signals transmitted to the regulator of a turbine engine of redundant type.

7. The device according to claim 1, wherein the transformed angular position signal comprises a voltage signal for the regulator by voltage of turbine engines.

8. The device according to claim 1, wherein the pilot control element comprises a lever or a mini-joystick.

9. The device according to claim 1, wherein the pilot control element comprises an emergency stop command device.

10. The device according to claim 1, further comprising an operator interface able to offer an operator:

selection and addition of the selected command law, and input and modification of pilot control element parameters.

11. The device according to claim 10, wherein the pilot control element parameters comprise a deflection of the pilot control element, position of lever stops, a desired angular position value, an acceleration per angular unit and a deceleration per angular unit.

12. The device according to claim 1, wherein said voltage is a continuous voltage.

13. The device according to claim 12, wherein said at least one interface comprises a resolver.

14. The device according to claim 1, wherein said different turbine engines have native command by sinusoidal type signals.

15. The device according to claim 9, wherein said emergency stop command device comprises a push button.

16. A test bench for a turbomachine comprising a throttle device according to claim 1.

17. A turbomachine comprising a throttle device according to claim 1.

* * * * *